United States Patent [19]

Jones

[11] Patent Number: 4,830,863

[45] Date of Patent: May 16, 1989

[54] PACKAGING

[76] Inventor: Arthur N. Jones, 1 Pikelaw Place, West Pimbo, Skelmersdale, Lancashire, England

[21] Appl. No.: 100,187

[22] Filed: Sep. 23, 1987

[30] Foreign Application Priority Data

Sep. 23, 1986 [GB] United Kingdom ..... 8622905

[51] Int. Cl.[4] ..... A23B 7/152

[52] U.S. Cl. ..... 426/118; 426/126; 426/127; 426/396; 426/419

[58] Field of Search ..... 426/419, 396, 126, 118, 426/127

[56] References Cited

U.S. PATENT DOCUMENTS 2,893,877 7/1959 Nickolls ..... 426/396
4,055,672 10/1977 Hirsch et al. ..... 426/129
4,379,008 4/1983 Gross et al. ..... 426/113
4,642,239 2/1987 Ferrar et al. ..... 426/396

*Primary Examiner*—Donald E. Czaja
*Assistant Examiner*—Helen Pratt
*Attorney, Agent, or Firm*—Connolly and Hutz

[57] ABSTRACT

A package is disclosed for natural products and comprises a first wall region of thermoplastic material and a second wall region which comprises a porous substrate hermetically sealed at its edges to the thermoplastic material and covered with a gas-permeable layer of polymethylpentene. The area of the porous substrate and its outer covering of polymethylpentene is selected in relation to the total area of the package and in dependence upon the natural products to permit a desired atmosphere to be maintained within the package as a result of respiration of the natural products and gas transfer through the porous substrate.

15 Claims, 5 Drawing Sheets

PACKAGING

Figure 1:
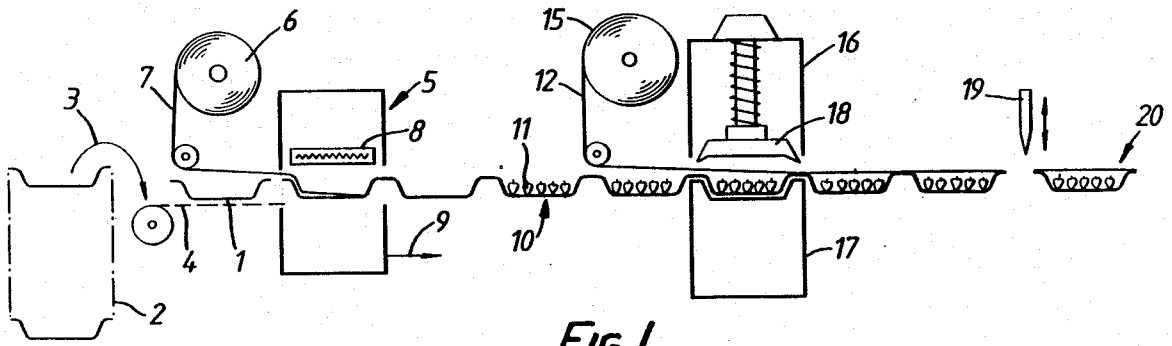

This invention relates to packaging and is concerned with providing a package with a high permeability to enable high gas exchange rates to be achieved through the package. The invention is particularly concerned with providing packages in which highly sensitive natural products, such as strawberries and mushrooms can be held in storage in so-called cold chains for periods of two or three weeks without substantial deterioration.

When natural products, such as strawberries or mushrooms, are stored they undergo a form of respiration and if they were kept in a gas-impermeable package the oxygen present in the ambient atmosphere would be rapidly used to produce carbon dioxide and the products would then undergo anaerobic spoilation. In order to prevent spoilation even at low temperatures it is necessary to maintain in contact with the products an atmosphere rich in carbon dioxide and low in oxygen relative to the ambient air. In the case of strawberries, such an atmosphere generally comprises from 6 to 10% by volume of carbon dioxide and 1 to 4% by volume of oxygen, e.g. 8% carbon dioxide and 2% oxygen. In the case of other natural products a different final carbon dioxide rich and oxygen poor atmosphere may be required. Such an atmosphere cannot be maintained in a porous package but only by use of a gas-permeable membrane. However, modern packaging techniques cannot be used with gas-permeable materials to provide packages of the required gas permeability at different storage temperatures.

According to the present invention there is provided a package for natural products, the package being formed of or lined with a thermoplastics material in which a part of the wall of the package comprises a porous substrate covered with a gas-permeable layer of polymethyl pentene, the porous substrate having been heat-sealed to the surrounding part of the wall of the package in such a manner that the thermoplastic material extends through the porous substrate to provide a hermetic seal at the edge(s) thereof, the area of the porous substrate in relation to the total area of the package being selected in relation to the natural products contained or to be contained within the package to permit a desired atmosphere to be maintained within the interior of the package as a result of respiration of the natural products and gas transfer through said porous substrate.

With the present package, it will be appreciated that the nature of the atmosphere within the package will firstly depend upon the atmosphere in which the natural products were placed in the package. Thus if the products are packaged using a conventional controlled atmosphere packaging machine, then the initial atmosphere within the package is predetermined. The natural products in the package undergo a form of respiration and the rate at which this occurs depends upon the temperature. Thus the nature of the atmosphere within the package will depend upon the kind of natural product which is packaged and the temperature at which the package is stored. As the natural products respire oxygen in the package is converted to carbon dioxide but as the layer of polymethyl pentene is permeable to oxygen, oxygen will enter the package through the polymethyl pentene and porous substrate to maintain within the package the required low oxygen content and thus to prevent anaerobic spoilation of the natural products.

The rate at which the oxygen enters the package can be controlled by controlling the area of gas-permeable polymethyl pentene available for oxygen transport or its permeability. This can be effected by means externally of the package. The rate of respiration and thus the rate at which oxygen is required within the package can be controlled by controlling the temperature of the package.

Accordingly, the present invention also provides a method of storing a natural product in a package in order to maintain within the package a required atmosphere at a particular storage temperature, characterised in that at a first low storage temperature at which a reduced degree of permeability is required, the package is stored with the gas-permeable layer of polymethyl pentene resting on a supported septum of material having a required low degree of permeability, that at a second and higher low storage temperature the package is stored with the gas-permeable layer of polymethyl pentene resting on a supported septum of material having a required higher degree of permeability, and that at a final and ambient temperature the package is stored or presented with said gas-permeable layer of polymethyl pentene available to the ambient atmosphere. If each package is in the form of a tray or receptacle having lid comprising said porous substrate covered by a gas-permeable layer of polymethyl pentene, then, at one of said temperatures, the packages may conveniently be stored with their lids in contact.

In one preferred embodiment of the package of the present invention, the package comprises a tray or receptacle to receive the products the tray or receptacle being lined with the thermoplastics material, and a lid comprising the porous substrate covered with a gas-permeable layer of polymethyl pentene.

The tray or receptacle is preferably made of porous fibrous material, such as moulded fibre pulp, paper, cardboard or fibre board made in conventional manner by moulding fibres deposited by paper-making techniques. Alternatively, the tray or receptacle may be made from bonded wood chips, bonded fibre material or other suitable porous material. The tray or receptacle may also be made of formed open-cell or fibrous structures of plastics. The tray or receptacle is lined with a thermoplastic material, preferably an ionomeric polymeric material, such as that known under the Registered Trade Mark "SURLYN". Such ionomeric material is a polymer of that class of polymers in which ionised carboxyl groups create ionic cross-links in the molecular structure, which links are reversibly broken at melt temperatures. Such material will hereinafter be referred to as "ionomer" for convenience.

Other lining materials may be used for the tray or receptacle such as a composite liner of ionomer/polyvinylidene chloride/ionomer, a polyolefin such as polyethylene or polypropylene or a blend of a polyolefin and vinyl acetate, and the lining will be chosen in accordance with the degree of permeability required.

If, however, a transparent package is required, the tray or receptacle may be formed of ionomer or of a composite film with a thermoplastics material, such as ionomer, a polyolefin or polyvinyl chloride in the inside, and it may be necessary to treat the inside of the tray or receptacle to avoid misting and obscuring of the view of the contents due to condensation.

Alternatively, the tray or receptacle may be formed of or lined with a polymeric material incorporating anti-fogging additives.

As a further alternative, a tray or receptacle of porous fibrous material could be formed with cut-outs, bridged by the thermoplastics material, through which the contents of the package may be viewed.

As indicated above, the lid is made of a porous material covered with a gas-permeable layer of polymethyl pentene. The porous material is preferably paper and conveniently one which has a base weight of 30 to 80 $g/m^2$, preferably 50 $g/m^2$. However, other porous materials may be used, such as a micro-porous polypropylene film such as that known under the Registered Trade Mark "VALMIC". The latter material would be particularly suitable for a tray or receptacle lined with polypropylene.

After the tray or receptacle has been filled with the product, the lid is laid on the tray or receptacle with porous material side down and heat and pressure are applied to melt the thermoplastic lining of the tray or receptacle sufficiently for the thermoplastics material to flow through the porous material so as to provide a hermetic seal at the edge of the tray or receptacle.

Alternatively, the lid can be sealed to the tray or receptacle at the edge of the tray or receptacle using an ultrasonic sealing system in which the edges of the tray and the lid are trapped between a focussing horn of an ultrasonic generator and the rigid profile of a basal tool lying under the edges of the tray. The focussing horn has a flat surface which presses the lid onto the edges of the tray while the basal tool supports the tray and its contents. A seal of high hermetic integrity can be made in this manner.

In accordance with one aspect of the present invention, in order to be able to view the contents of the package, the lid is formed with a transparent region which may or may not be porous or gas-permeable, but preferably is.

By appropriate choice of the material or materials of which the transparent region is made and the extent of the region, the total gas permeability of the lid can be varied as required in accordance with the respiration dynamics of the produce to be contained in the package so as to meet the specific requirements of the produce.

In one embodiment of this aspect of the invention, the lid may be in the form of, for example, three strips, the two outer ones comprising paper covered with a gas-permeable layer of polymethyl pentene while the central strip comprises a layer of polypropylene in contact on one side with the edges of the paper strips, the other side of the polypropylene being coated with ionomer. The lidding material can be formed from two outer rolls of polymethyl pentene-coated paper and a central roll of ionomer coated polypropylene. Three webs are unrolled from these rolls and passed in contact through a heat-sealing system so that the webs are heat-sealed together at their edges in such manner that the polypropylene extends throughout the paper at the edges to provide a hermetic seal. The resulting web is then rewound to provide a roll of composite lidding material.

In other embodiments of this aspect of the invention, the transparent region can be made solely of ionomer, or may be made of polypropylene, particularly where the tray or receptacle is lined with polypropylene. Appropriate premade rolls of the lidding material can be prepared in the manner just indicated for these other embodiments.

In yet another embodiment of this aspect of the invention, the package can be provided with a lid of polypropylene of a thickness of 50 to 200 micron which is transparent but substantially gas-impermeable. In order to provide the package with the required degree of permeability, a region of the polypropylene lid is perforated and the perforations are covered by a layer of paper coated with polymethyl pentene, the paper being heat sealed to the lid at the sides of the perforate region and in the non-perforate area. Again the heat-sealing of the paper to the polypropylene lidding material and the heat-sealing of the polymethyl pentene to the paper are carried out in such manner that the materials extend throughout the paper at the edges to provide a hermetic seal. As before, premade rolls of lidding material can be prepared.

This latter package is especially useful where the trays or receptacles are lined with polypropylene.

It will be appreciated that it is important that an hermetic seal is achieved at the edges of the paper so as to prevent unrestricted access of air to the interior of the package and so that the atmosphere in the package is controlled solely by the choice of materials and their extent in relation to the produce to be packaged.

As indicated above, the tray or receptacle may be formed of a polymeric material such as ionomer or a composite film and the inside may be treated to avoid misting. In a development of this aspect of the invention, the receptacle may be in the form of a bag which may be made of gas-impermeable or gas-permeable material and the bag is provided with a region of high or higher permeability constituted by a porous substrate covered with a gas-permeable layer of polymethyl pentene. In one embodiment of this development a bag of polypropylene could be provided with a region of perforations covered by a layer of paper coated with polymethyl pentene as just described or a bag could be formed from a layer of polypropylene heat sealed at its edges to a layer of paper coated with polymethyl pentene.

In accordance with a further aspect of the present invention the requirement for the packages to have different degrees of gas permeability during storage in cold chains and in display cabinets can be met by arranging for part of the gas-permeable layer of polymethyl pentene to be pulled off the paper. This is possible due to the nature of the bond between paper and polymethyl pentene which is not as good as some other thermoplastic materials to paper. Thus by making appropriate cuts and/or score lines in the polymethyl pentene, it is possible to peel back a region of the polymethyl pentene so as to increase the degree of gas-permeability of the package.

As an extension of this latter modification, the packages could be secured to an appropriate septum in a display cabinet by means of double sided adhesive tape or by adhesive applied over the region to be peeled back, so that when the purchaser removes a package from the display cabinet the required region of polymethylpentene will be removed at the same time and will remain attached to the septum. If required, an additional piece of polymethyl pentene coated tape or the like could be provided with the package to cover the exposed region if the package were to be returned to cold storage.

The packages of the present invention are suitable for use in packaging produce using controlled atmosphere or modified atmosphere packaging techniques but for certain items of produce it may be sufficient to pack in air and to allow the required controlled atmosphere to develop after packaging as the result of respiration of the produce.

Figure 2:
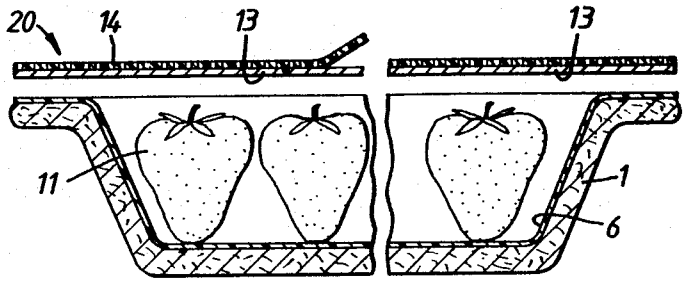
Figure 4:
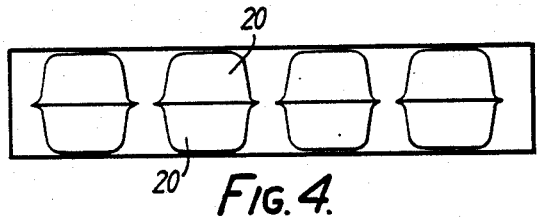
Figure 5:
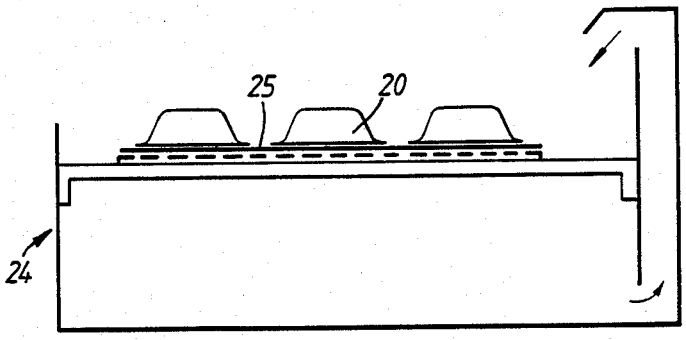
Figure 6:
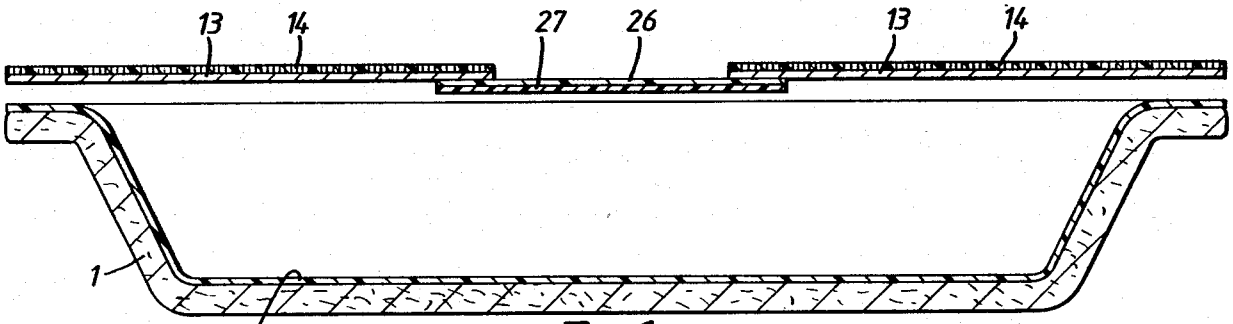
Figure 7:
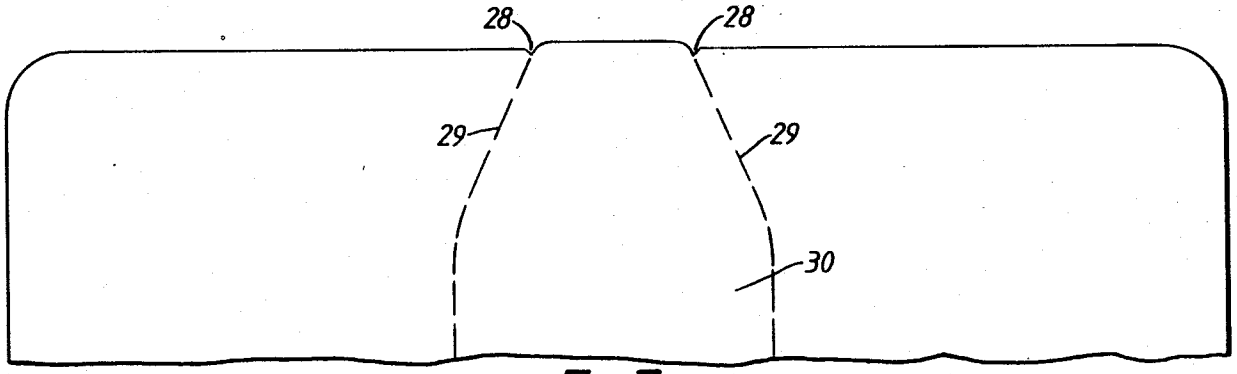
Figure 8:
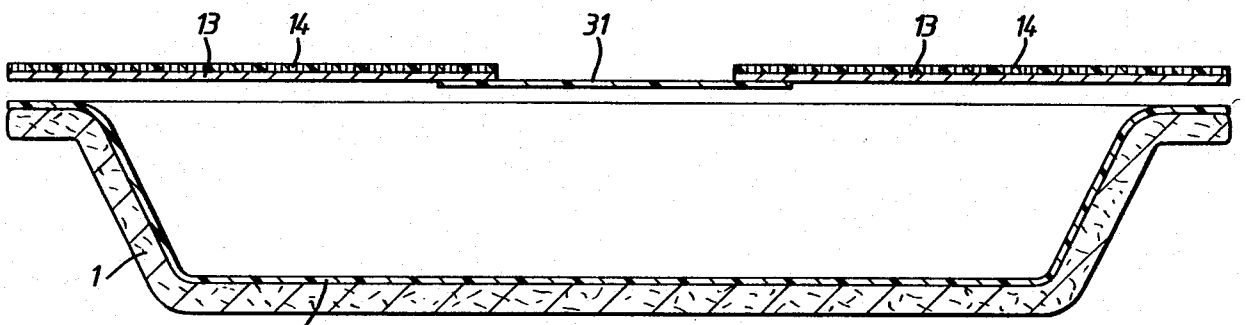
Figure 9:
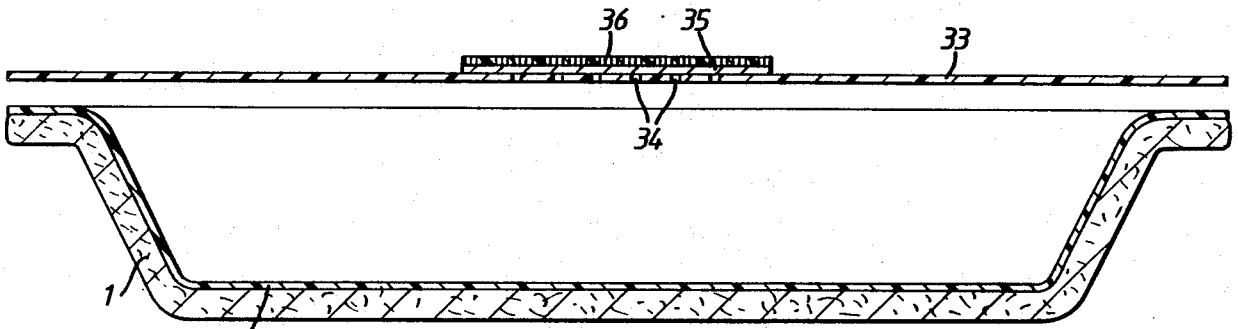
Figure 10:
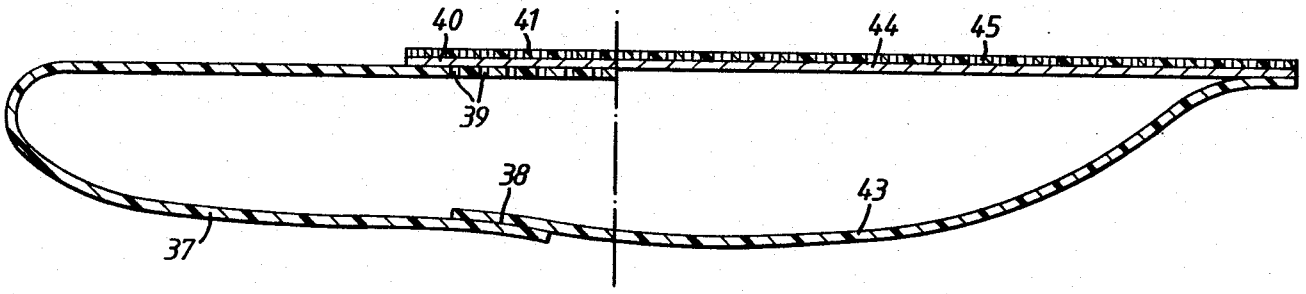
Figure 11:
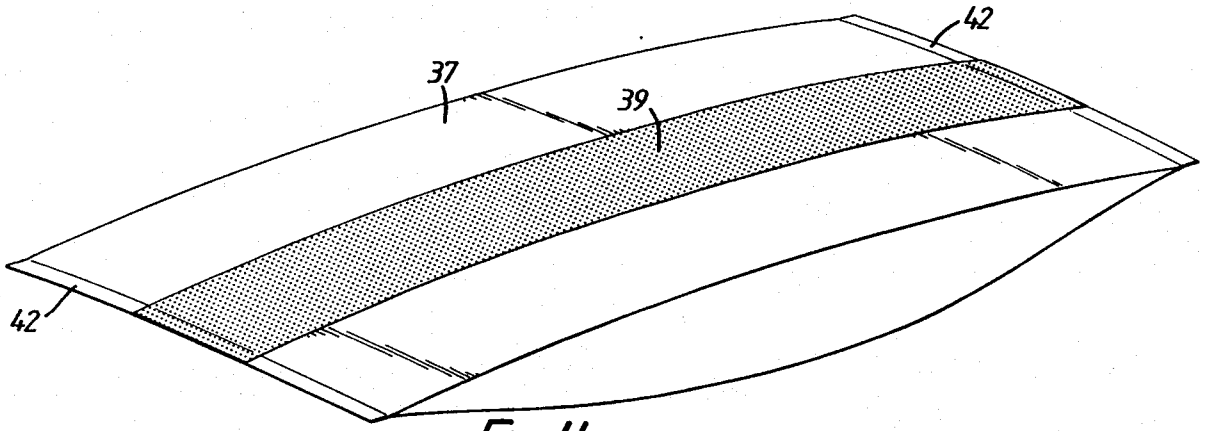

In order to enable the invention to be more readily understood, reference will now be made to the accompanying drawings, which illustrate diagrammatically and by way of example some embodiments thereof, and in which:

FIG. 1 shows plant for packaging natural products,

FIG. 2 is a partly exploded section through a package produced by the plant shown in FIG. 1, FIGS. 3, 4 and 5 show different ways of storing the packages, FIG. 6 is a cross-section through another package, FIG. 7 is a part-plan view of yet another package, FIG. 8 is a cross-section through a further package, FIG. 9 is a cross-section through yet a further package, FIG. 10 is a cross-section showing two different packages, and, FIG. 11 is a perspective view of the package shown in the left hand side of FIG. 10.

Referring now to FIG. 1, there is shown plant in which packages of strawberries are to be produced. Preformed containers in the form of flanged trays 1 of porous fibre material, e.g. moulded fibre trays are taken from a stack 2 of trays by destacking apparatus indicated by arrow 3 and placed in rows across a conveyor 4 so as to form a closely spaced array of trays on the conveyor. The trays 1 are fed to a thermo-forming station 5. A reel 6 of ionomer film having a thickness of 125 microns, but which may have a thickness of from 80 to 300 mm, is mounted above the conveyor 4 and the film is united with the trays at the thermo-forming station 5 so as to line the trays with the film and unite the trays. The film is coherently bonded to the tray by being heated by a heater 8 and by being drawn downwardly by a vacuum applied at a vacuum outlet 9.

After leaving the thermo-forming station, the trays are passed to a loading station 10 where they are filled with the strawberries 11 to be packaged. A lidding material 12 in the form of a web of paper 13 having a base weight of 50 g/m$^2$ coated with a film 14 of polymethyl pentene 20 microns thick is unwound from a reel 15 located above the flow path of the trays and brought to cover them. The two webs are then combined in a heat-sealing machine 16 using a shaped supporting tool 17 shaped to receive the trays and an overhead sealing plate 18. The heat-sealing is effected under pressure at a temperature of 170° C. for a time sufficient to ensure that the ionomer lining of the tray melts sufficiently to flow through the paper to provide a hermetic seal at the flanges of the tray.

The filled trays leaving the heat-sealing machine are separated by a knife 19 into individual packages 20 which are passed to storage in a so-called 'cold chain' where they are held at a temperature of 5°±1° C.

It will be appreciated that many modifications of the packages and packaging method just described are possible. Thus, for example, it is possible to use individual trays at the loading station, the trays being fed from destacker apparatus. The individual trays may be made of porous fibre material with a lining of thermoplastics material, such as an ionomer, or may be trays thermoformed from polyvinyl chloride or even from ionomer. The material of the trays and any linings thereof will be chosen in accordance with the required storage parameters for the natural product to be stored. The sealing of the lid to the tray may be carried out in commercially available equipment and, if desired, under controlled atmosphere conditions, so that the optimum atmosphere for storage is provided in the package ab initio.

FIG. 2 shows the finished package in more detail with the tray 1 lined with ionomer 6 and the lid of paper 13 covered with a film 14 of polymethyl pentene.

The packages thus produced have a very high gas permeability at the lid due to the covering of polymethyl pentene which has a gas-permeability of 100,000 ml/m$^2$/24 hours/atmosphere differential for a thickness of 25 microns at N.T.P. as compared with a figure of 15,000 for highly plasticised polyvinyl chloride. In addition the tray itself also has a degree of gas permeability due to the lining of ionomer.

Figure 3:
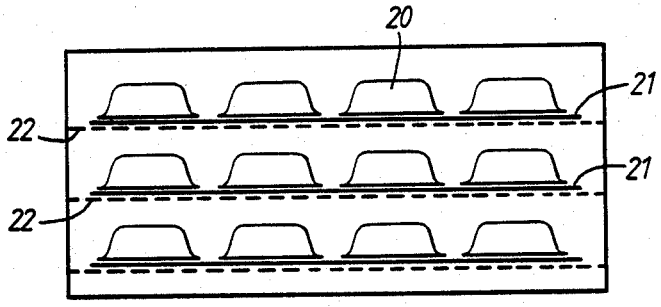

When the packages are stored in a cold chain at 5°±1° C., the rate of respiration is slower and the degree of permeability which the package needs in order to maintain the required carbon dioxide rich-oxygen poor atmosphere is reduced, such atmosphere generally comprising 8% by volume carbon dioxide and 4% volume oxygen. Therefore, the packages in the cold chain are stored with their lidding material resting on a supported septum of material having a reduced permeability as shown in FIG. 3 where the packages 20 are stored in an inverted position with the lids resting on a septum 21 which itself rests on a openwork support 22. Alternatively, as shown in FIG. 4, the packages can be stored with their lids in contact in which case the atmosphere in the packages is controlled by the gas-permeability of the ionomer lining to the trays.

When the packages are displayed in point of sale display cabinet 24 in which the temperature is in the region of 10° C., a different degree of permeability is required and this can be achieved using a different supported septum 15 as shown in FIG. 5. When the packages are purchased and removed from the display cabinet, the high degree of gas-permeability which is now required is available through the lid.

Thus the present packages enable a wide range of sensitive natural products to be stored with a wide range of ga permeabilities which can be selected with reference to the requirements of the products and by appropriate use of storage conditions and temporary coverings for the lids.

Strawberries have been successfully stored in the present packages in a cold chain for as long as two weeks without noticeable deterioration.

It will be appreciated that, if required, the natural products could be packaged in the heat-sealing machine by a modified atmosphere packaging process to provide the required atmosphere ab initio for storage in the col chain. By using septums of different gas permeabilities to cover the lids, it is possible easily to alter the gas exchange rates to higher or lower levels as demanded by temperature changes encountered as the packages are handled under conditions other than uniform storage conditions. Suitable septums include coated boards, perforated films, microporous films and cellular plastics.

FIGS. 6 to 9 show various packages similar to that shown in FIG. 2 which can also be produced on the plant shown in FIG. 1 using appropriate lidding materials 12.

Referring now to FIG. 6 there is shown a package comprising a moulded fibre tray 1 lined with ionomer 6 and having a three-part lid the two outer parts of which each comprise a layer of paper 13 covered with a film 14 of polymethyl pentene. The central part of the lid, however, consists of a layer of transparent polypropylene 26 beneath which is a layer of ionomer 27. The central part may be made of any desirable width consonant with the permeability requirements of the package as a whole.

The lid may be formed by providing otter rolls of polymethyl pentene-lined paper and a central roll of ionomer-lined polypropylene, unrolling the materials so that they overlap and heat-sealing the overlapping edges such that the polypropylene extends through the paper to provide a hermetic seal. The resulting three-part material can then be wound up again and used as the lidding material 12 in the plant shown in FIG. 1.

FIG. 7 shows a package in which a lid of paper covered with a layer of polymethyl pentene 14 is formed at one edge with notches 28 leading to score lines 29 in the polymethyl pentene layer so that the polymethylpentene layer 30 between the score lines can be peeled back to expose the paper thereby altering the permeability characteristics of the package. If desired, a tab could be provided to facilitate gripping of the layer 30.

Referring now to FIG. 8, there is shown a package similar to that shown in FIG. 6 but in which the central transparent part of the lid consists solely of a layer of transparent polypropylene or ionomer 31, preferably having a thickness of 50 to 200 microns. In other respects the package is the same as that shown in FIG. 6.

FIG. 9 shows a package in which the moulded fibre tray 1 is lined with polypropylene 32 and has a lid 33 also of polypropylene. The lid 33 has a central region formed with perforations 34 and the perforated region is covered with a layer of paper 35 coated with a layer of polymethyl pentene 36. The layer of coated paper extends beyond the perforated region of the lid and is heat-sealed to the lid so that the polypropylene extends through the paper to provide a hermetic seal.

FIG. 10 shows a package in which the receptacle is in the form of a bag. As shown in the left hand side of FIG. 10, the bag is formed from a sheet of polypropylene 37 which is folded on itself and heat sealed at 38. A central region of the bag is formed with perforations 39 and these are covered by a layer of paper 40 coated with a layer of polymethyl pentene 41 in the manner described with reference to FIG. 9. FIG. 11 shows the package formed by heat sealing the ends at 42.

The right hand side of FIG. 10 shows a bag formed from a sheet of polypropylene 43 sealed at its edges to a layer of paper 44 coated with polymethyl pentene 45.

As with the other embodiments, the bags of FIG. 10 can be chosen to have a gas-permeability in accordance with the specific requirements of the produce to be packaged by appropriate choice of materials, extent of perforations, etc.

What is claimed is:

1. A package for natural products, comprising, a first wall region comprising a thermoplastic material, and a second wall region comprising a porous substrate covered with a gas-permeable layer consisting of polymethyl pentene, the porous substrate having been heat-sealed around its edges to said thermoplastic material to form an enclosed package with the thermoplastic material extending through the porous substrate to provide a hermetic seal at said edges, said layer of polymethyl pentene lying on the exterior of the package, the area of the porous substrate in relation to the total area of the package being selected in relation to the natural products contained or to be contained within the package to permit a desired atmosphere to be maintained within the interior of the package as the result of respiration of said natural products and gas transfer through said porous substrate.

2. A package for natural products, comprising a flanged receptacle of porous fibrous material, a lining of thermoplastic material to said receptacle and constituting a first wall region to said package, and a lid to said receptacle, the lid consisting of a porous substrate covered with a gas-permeable layer of polymethyl pentene, the porous substrate having been heat-sealed to said lining at the flange to said receptacle in such a manner that the thermoplastic material of said lining extends through the porous substrate to provide a hermetic seal at said flange, said layer of polymethyl pentene lying on the exterior of the package, the area of the porous substrate in relation to the total area of the package being selected in relation to the natural products contained or to be contained within the package to permit a desired atmosphere to be maintained within the interior of the package as the result of respiration of said natural products and gas transfer through said porous substrate.

3. The package of claim 2, said lid having a transparent region.

4. The package of claim 2, said porous substrate comprising paper having a base weight of 30 to 80 $g/m^2$.

5. The package of claim 2, said porous substrate comprising a microporous polypropylene film.

6. The package of claim 2, a region of said lid being formed with notches and score lines in said layer of polymethyl pentene to permit part of said layer to be removed.

7. The package of claim 2, said porous fibrous material being selected from the group consisting of moulded fibre pulp, paper, cardboard, fibre board, bonded wood chips, bonded fibre material, open-cell plastics and fibrous plastics.

8. The package of claim 2, said thermoplastic material being selected from the group consisting of ionomer, a polyolefin and a blend of polyolefin vinyl acetate.

9. The package of claim 2, said receptacle being formed with cut-outs bridged by said lining.

10. A package for natural products, comprising a first wall region comprising a thermoplastic material, a second wall consisting of a thermoplastic material, the second wall region being formed with an unperforated region and a region of perforations, and a porous substrate covered with a gas-permeable layer of polymethyl pentene overlying said region of perforations, the porous substrate having been heat-sealed around its edges to said thermoplastic material to form an enclosed package with the thermoplastic material extending through the porous substrate to provide a hermetic seal at said edges and surrounding said region of perforations, said layer of polymethyl pentene lying on the exterior of the package, the area of the porous substrate in relation to the total area of the package being selected in relation to the natural products contained or to be contained within the package to permit a desired atmosphere to be maintained within the interior of the package as the result of respiration of said natural products and gas transfer through said porous substrate.

11. The package of claim 10, said thermoplastic materials comprising polypropylene.

12. The package of claim 10, and further comprising a flanged receptacle of porous fibrous material, said first wall region constituting a lining to said receptacle and said second wall region constituting a lid to said receptacle and sealed to said first wall region.

13. The package of claim 12, said porous fibrous material being selected from the group consisting of moulded fibre pulp, paper, cardboard, fibre board, bonded wood chips, bonded fibre material, open cell plastics and fibrous plastics.

14. The package of claim 10, said porous substrate comprising paper having a base weight of 30 to 80 $g/m^2$.

15. The package of claim 10, the first and second wall regions being integral and together constituting a bag.

* * * * *